US007600662B2

(12) United States Patent
Nayrac et al.

(10) Patent No.: US 7,600,662 B2
(45) Date of Patent: Oct. 13, 2009

(54) FASTENING DRIVING TOOL WITH PIVOTALLY MOUNTED MAGAZINE AND MAGAZINE THEREFOR

(75) Inventors: Frederic Nayrac, Bourg les Valence (FR); Cyril Marion, Bourg les Valence (FR); Bruno Toulouse, Tain l'Hermitage (FR)

(73) Assignee: Societe de Prospection Et d'Inventions Techniques SPIT, Bourg les Valence (FR)

( * ) Notice: Subject to any disclaimer, the term of this patent is extended or adjusted under 35 U.S.C. 154(b) by 334 days.

(21) Appl. No.: 11/569,872

(22) PCT Filed: May 27, 2005

(86) PCT No.: PCT/IB2005/001495

§ 371 (c)(1),
(2), (4) Date: Nov. 30, 2006

(87) PCT Pub. No.: WO2005/118228

PCT Pub. Date: Dec. 15, 2005

(65) Prior Publication Data

US 2008/0283568 A1 Nov. 20, 2008

(30) Foreign Application Priority Data

Jun. 2, 2004 (FR) ..... 04 05905

(51) Int. Cl.
*B25C 1/08* (2006.01)

(52) U.S. Cl. ..... 227/120

(58) Field of Classification Search ..... 227/120, 227/127, 128, 156

See application file for complete search history.

(56) References Cited

U.S. PATENT DOCUMENTS

| | | | | |
|---|---|---|---|---|
| 3,437,250 | A * | 4/1969 | Fiedler | 227/127 |
| 3,464,614 | A | 9/1969 | Dieter | |
| 3,834,602 | A * | 9/1974 | Obergfell | 227/120 |
| 4,389,012 | A * | 6/1983 | Grikis et al. | 227/120 |
| 4,570,840 | A * | 2/1986 | Bull | 227/8 |
| 4,669,648 | A * | 6/1987 | Monacelli | 227/109 |
| 4,801,062 | A * | 1/1989 | Austin | 227/128 |
| 4,809,849 | A * | 3/1989 | Kozyrski et al. | 206/343 |
| 5,025,968 | A | 6/1991 | Nasiatka et al. | |
| 6,161,746 | A * | 12/2000 | Wey | 227/109 |
| 6,431,428 | B1 | 8/2002 | Chen | |
| 2004/0188491 | A1 * | 9/2004 | Huang | 227/120 |

FOREIGN PATENT DOCUMENTS

| | | | |
|---|---|---|---|
| DE | 3337278 | A1 | 4/1985 |
| DE | 10036078 | A1 | 2/2002 |
| GB | 2024691 | A | 1/1980 |

* cited by examiner

*Primary Examiner*—Brian D Nash
(74) *Attorney, Agent, or Firm*—Lowe Hauptman Ham & Berner, LLP

(57) ABSTRACT

A fastening element driving apparatus includes a barrel for receiving a fastening element, and a handle for attaching a removable magazine which feeds fastening elements to the barrel. A forward part of the apparatus is arranged to cooperate with a supply end of the magazine and ensure that a fastening element is transferred from the magazine into the barrel. A free end of the handle away from the barrel carries a rod for fixing another, loading end of the magazine thereto. The fixing rod is pivotable to alter a relative position between the free end of the handle and the loading end of the magazine.

18 Claims, 4 Drawing Sheets

FASTENING DRIVING TOOL WITH PIVOTALLY MOUNTED MAGAZINE AND MAGAZINE THEREFOR

RELATED APPLICATIONS

The present application is a National Phase entry of International Application Number PCT/IB2005/001495, filed May 27, 2005, which claims priority from, French Application Number 0405905, filed Jun. 2, 2004, the disclosures of which are hereby incorporated by reference herein in their entirety.

BACKGROUND

This invention is in the field of fixing equipment, in particular equipment that uses gas or internal combustion motors. This equipment operates using the principle of an explosion of an inflammable mixture of gas and air in the motor combustion chamber (formed in part by a cylinder, a cylinder barrel and a cylinder head) to propel a piston for driving a fastening element.

The motor is fitted inside a casing.

The casing is fitted inside two shells of a handle, and to the front and rear of which are fitted a handle with a housing for holding a battery to provide electrical power and a means of fitting a removable feeder magazine for the fastening elements. More precisely, to the rear, the motor cylinder head, the casing and the shells of the handle are fitted together using the same bolts.

When the inflammable mixture in the combustion chamber is pressurised, a force directed towards the rear acts on the cylinder head and therefore on the casing to which it is connected.

Conversely, when under the action of the explosion the piston is propelled forwards, it comes to a stop against a damper which is connected to the cylinder. A force which is directed forwards then acts on the cylinder and on the casing to which it is connected.

In brief, the casing which is generally made from a plastic material, is subjected to high levels of compression stress, up to 60% of all the stresses.

The casing for gas powered fixing, equipment already acts as an elastic damper since it manages to stretch a little.

SUMMARY

The applicant has realised that the casing will deform where this occurs most readily, that is, at the front of the equipment. The magazine therefore must be firmly fixed to the nose or muzzle-bushing of the apparatus in order to maintain a proper supply of the fastening elements. If, however, the front of the apparatus moves (under the action of the forward part of the casing) relative to the rest of the apparatus and the supply end (or output end) of the fastening element magazine moves with it, whilst the other loading end (or input end) of the magazine remains firmly fixed to the handle, the supply of fastening elements into the muzzle bashing of the apparatus may not be correctly performed.

This is one of the reasons which have led the applicant to put forward its invention. There is at least one other reason.

In gas powered fixing apparatus there are quite a high number of long components. Even if the manufacturing tolerances are met, cumulative dimensional errors, which are individually tolerable, may either result in assembly difficulties or even in operating problems after assembly. The applicant has therefore also sought to ensure that there is compensation for the dimensions involved.

It should be noted that although the invention has been conceived from problems observed in gas powered equipment, there is no reason not to extend it to other types of apparatus such as equipment driven by powder or pneumatic equipment.

The invention therefore involves, in the first place, apparatus for fixing of fastening elements, comprising a barrel and means of driving a fastening element inside the barrel, a handle containing means for receiving a removable magazine tor fastening elements, with the front of the apparatus being arranged so as to cooperate with the feed end of the magazine and to ensure the transfer of a fastening element from the magazine into the barrel, with the free end of the handle, away from the barrel, being arranged so that the other loading end of the magazine may be fixed thereto, the apparatus being characterised by the fact that the aforementioned free end of the handle carries a fixing rod for the aforementioned loading end of the magazine, with the rod being mounted so that it can pivot and alter the relative position of the free end of the handle and of the loading end of the magazine. Thus, if the front of the apparatus moves, it can carry with it the feed end of the magazine, since this can also carry with it the other (loading) end of the magazine. In addition, the freedom of the loading end of the magazine to move on the handle of the equipment means that dimensional compensation can be carried out on assembly.

The rod is preferably to be mounted so as to pivot against the action of return means.

It is an advantage if the magazine fixing rod on the free end of the handle is cylindrical and mounted so that it pivots around a point on its axis.

The rod is preferably mounted in a ball and socket joint fitted in the handle of the equipment.

In this case the socket is preferably mounted in an elastic return sleeve.

The rod may be threaded and bear at its threaded end a thumb wheel for tightening the magazine, preferably through a head on the rod that is arranged so that it comes to rest against the magazine and tightens it against the handle.

In the preferred form of construction for the apparatus of the invention, the free end of the handle includes an inclined face arranged so that it cooperates with another inclined face on the magazine. It therefore forms a wedge and moves the magazine to the front of the apparatus so that the feed end is placed against the barrel.

In the case where the fixing rod crosses both inclined faces and has a tightening thumb wheel, this thumb wheel also carries out a pushing function.

The invention also involves a removable feed magazine for fastening elements for the apparatus of the invention, characterised by the fact that it includes means for receiving the fixing rod, with this means acting as a support for a head of the fixing rod and a structure shaped to provide an inclined face which cooperates with an inclined face in the handle of the apparatus to form a wedge and which moves the magazine towards the front of the apparatus to push its feed end against the barrel of the apparatus.

BRIEF DESCRIPTION OF THE DRAWINGS

The invention will be better understood using the following description whilst referring to the appended drawing, in which.

DETAILED DESCRIPTION OF THE DRAWINGS

Figure 1:
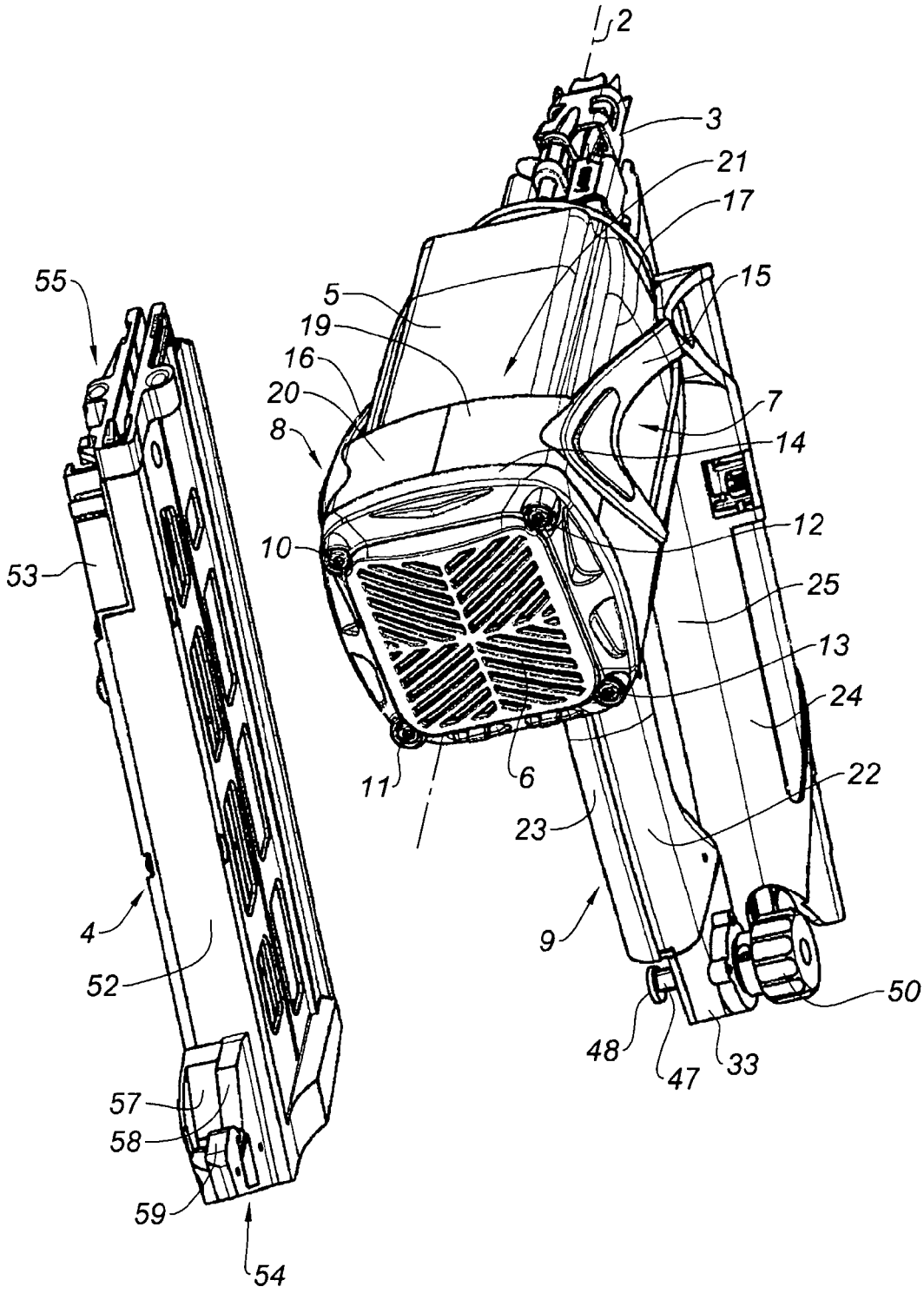
FIG. 1 is a top rear exploded perspective view of the apparatus of the invention and of the fastening element feed magazine.
Figure 2:
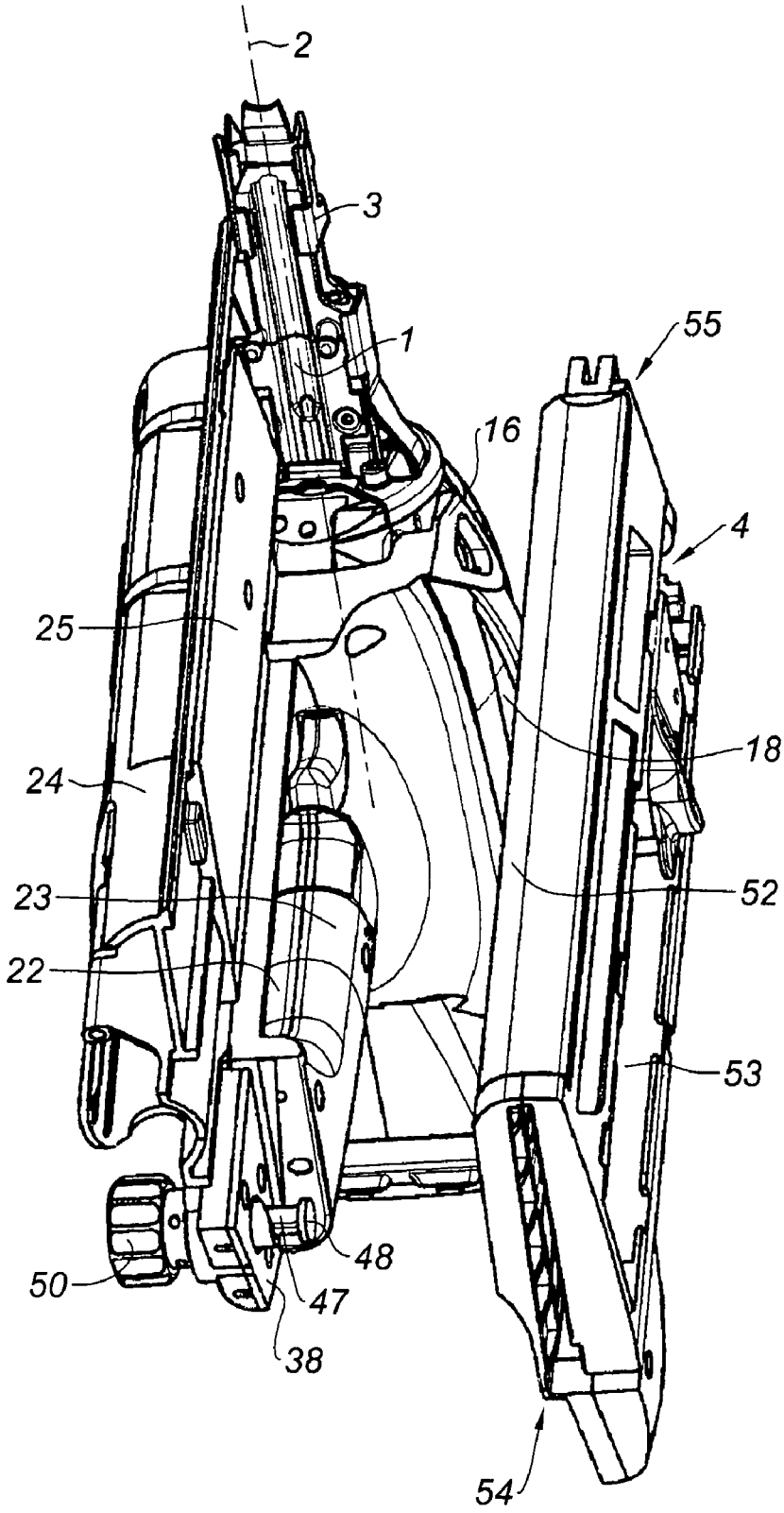
FIG. 2 is a bottom exploded front perspective view of the apparatus and magazine in FIG. 1.

The fastening apparatus now to be described will be in its internal combustion motor form, which is the preferred form, but which implies absolutely no limitations oil the invention.

The fastening apparatus included here therefore has an internal combustion motor, well known throughout the profession and designed to drive a fastening element inside barrel 1 in the apparatus along axis 2 through the nose or muzzle-bushing 3 of the apparatus into which the barrel extends, with the fastening element having previously been transferred into the barrel from the feed magazine 4.

The drive motor for the apparatus is fitted in a casing, the rear of which is closed off by a ventilation block 6 and the two shells 7, 8 of handle 9. Four fixing bolts 10-13 fix together the rear part 14 of casing 5, the block 6 and the handle shells 7, 8.

The handle shells are each made up of a cut-out framework 15 (16.) designed to be pushed against a lateral surface 17 (18) of the casing and at the rear a half-clamp 19 (20) which completes the rear enclosure of the casing 5 by means of the two half-clamps connected by a tongue and groove to form a fixing sleeve 21. Each handle shell is extended to the rear by means of a component of the handle itself 22 (23) and to the front by a structure 24 for housing an electrical supply battery and by a support structure 25 for the fastening element magazine 4.

The motor is therefore fitted in the casing 5 which is mounted in the assembly formed by the two shells 7, 8 of the handle 9 to which it is fitted at the rear by bolts 10-13.

Figure 3:
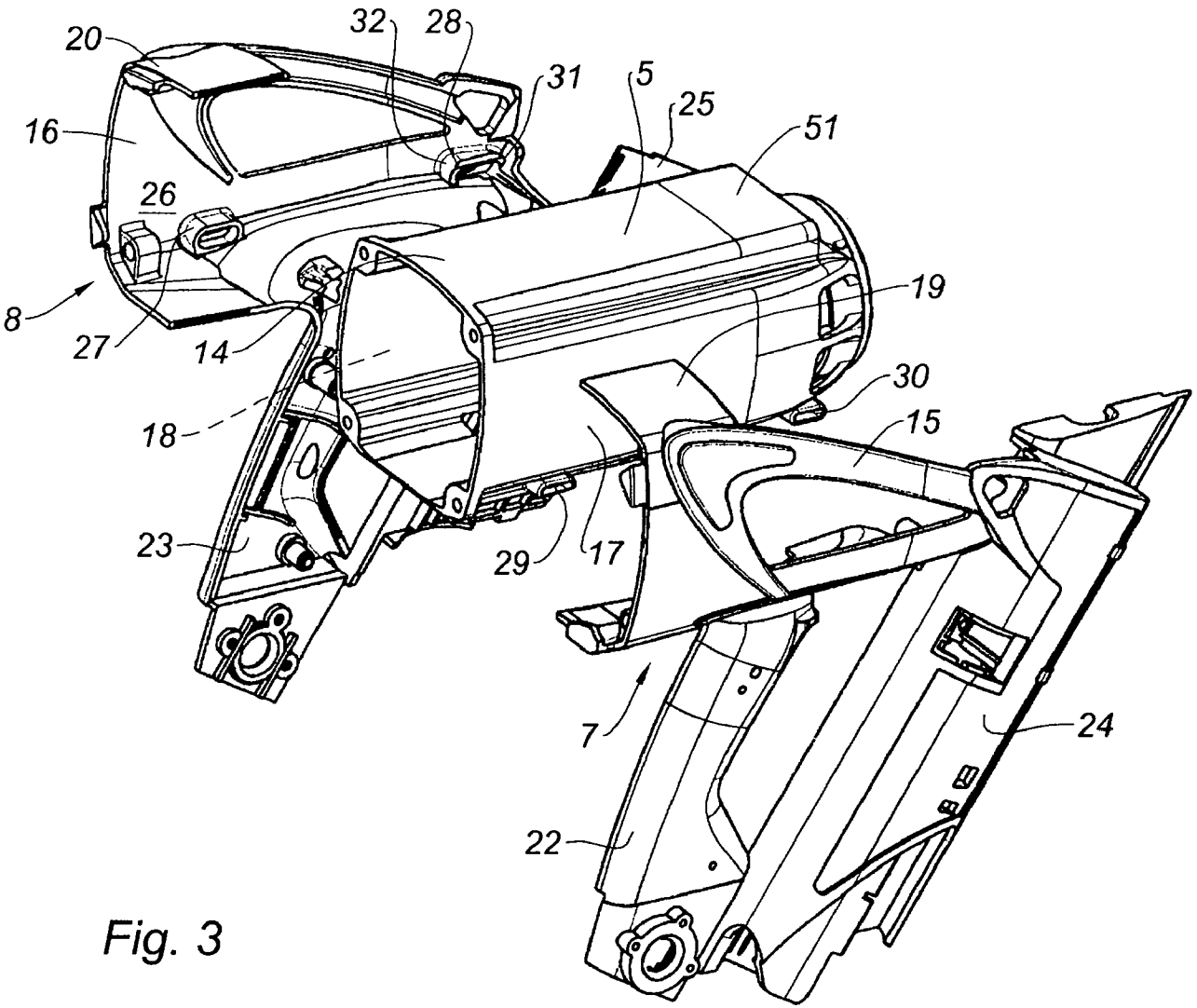
FIG. 3 is an exploded perspective view that slightly behind the casing and the shells of the handle of the apparatus.

On their interior surface 26, in the lower section close to the handle 22, 23, the flanges of the shells 15,16 possess, from the same moulds, small annular oblong channels, one 27 at the rear and one 28 at the front. In FIG. 3, only the internal surface and the channels in left flange 16 can be seen. As has already been stated, the fastening apparatus has a plane of symmetry passing through axis 2.

In the positions corresponding to those of channels 27, 28, the lateral walls 17, 18 of the casing 5 (at the lower part, therefore to the front and rear) also possess, from the same mould, small annular channels 29, 30. These are also of oblong cross-section and are intended, by means of the common sleeving, to act mortises and tenons with the channels 27, 28 of the flanges of shells 15, 16. Li FIG. 3, only channels 29, 30 of the lateral wall 17 of casing 5 can be seen. The rear tenons and mortises 29, 27 which have effectively the same internal and external cross-section must fit fully one inside the other. On the other hand, the front mortises and tenons 30, 28 must fit slightly one inside the other due to their transverse dimensions, but not their dimensions parallel to axis 2. In other terms, the axial external length of tenons 30 of the front part 51 of casing 5 is noticeably shorter than the internal axial length of mortises 28 precisely to allow the axial sliding of the tenons in the mortises.

Naturally, the respective arrangements of mortises and tenons may be reversed, with the tenons coming out of the handle shell mould. In all cases, the front tenons are shorter than the front mortises.

The annular front walls 31 and rear walls 32 of the front mortise-channels 28 make up the front and rear end-stop components for the front tenons 30 in the casing. Thus the front part 51 of the casing is a floating fit in the handle 7-9 and can be made to slide inside it in a direction which is parallel to the drive axis 2 for the fastening elements.

This is one of the reasons for the particular arrangement of the free end of handle 9 and of the feed end of the magazine 4, which will now be described, after a reminder that he compensation for the assembly dimensions of the apparatus was also at the origin of such an arrangement.

At the free end 33 of the handle 9, away from the barrel 1 and nose 3 of the apparatus, the shells 22, 23 joined together by bolts 34, 35 are shaped internally to take a spherical housing 36, with one part of the spherical surface in shell 22 and another part of the spherical surface in shell 23.

The spherical housing 36 opens onto the external surface 37 of shell 22 and to external surface 38 of shell 23 through two conical openings 39, 40, the usefulness of which will soon become apparent. The spherical housing 36 extends through a tubular hollow 41 along axis 42, perpendicular to surfaces 37, 38 of the shells of the handles, and which passes through the centre of the housing sphere. Its axial length is smaller than the diameter of housing 36, in the case in point, between a third and a quarter of this diameter, and its diameter is slightly larger than that of the sphere in housing 36, in the case in point, about a quarter more.

Housing 36 is holds a ball and socket joint 43 with a through tapped hole 44 crossing axis 42, at rest, and extending along the same axis 42 at rest, and which extends along axis 42 still at rest by means of two small tubular sections 45, 46 which are crossed by the threaded hole 44 and which emerge from the two shells 22, 23 through the conical openings 39 and 40.

The tubular extensions 45, 46 of ball and socket joint 43 have an external diameter that is slightly less than the small internal diameter of he conical openings 39, 40 with the tubular section 45, protruding outside the shell 22 being axially slightly longer than the other tubular section 46 opposite. The small tubular section 46 protruding outside the handle shell 23 is designed to fit inside a corresponding hollow in the magazine. A fixing rod 47, here cylindrical, extends into the threaded hole 44. The rod 47 carries at one end a support head 48, with its other end 49 being threaded. Onto the threaded end 49 of the rod 47 is screwed a threaded thumb-wheel which also fits into the tubular part 45 of the joint 43 up to an internal back face 51.

When the thumb-wheel 50 is screwed onto the threaded rod 47, with the thumb-wheel against the end face 51 against the tubular part 45 of joint 43, the thumb-wheel constrains the rod by moving the handle shells 22, 23 along axis 42 towards the head 48 and tightens, as will be seen below, the end of magazine 4 against the end face of the tubular portion 46 of joint 43.

The removable magazine 4 is also made of two shells 52, 52 between which (in a standard manner which is widely known in the trade) is introduced, through a loading end 54, a strip of fixing elements which will then be transferred one at a time through a feed end 55 of the magazine into the barrel 1 of the equipment which is thus fed with fastening elements (here nails).

It is in shell 52 of the magazine that the hollow 56 for receiving the tubular portion 46 of joint 43 is fitted. The head 48 of the rod is designed to be fitted in an opening in shell 53 of the magazine in order (under the action of thumb-wheel 50 and of the traction caused by screwing it in) that it comes against shell 52 and so tightens the magazine 4 onto the handle 9.

The magazine 4 is fitted onto handle 9 as follows.

After thumbscrew 50 and rod 47 at end 33 of the handle are withdrawn, the magazine is held flat against support structure 25 of the handle whilst its feed end 55 is held against the nose 3 of the apparatus in a perfectly standard manner.

The loading end 54 of magazine 4 is held flat against surface 38 of the handle shell 23 by fitting the tubular portion 46 of the joint 43 into the hollow 56 in the shell of magazine 52. The rod 47 is then slid into opening 57 in the shell 53 of the magazine and through a collar 58 fitted in shell 52 before it is inserted into the threaded hole 44, until its head 48 meets wall 59 of the collar 58 and the threaded portion 49 emerges from the tubular portion 45 of joint 43. The thumb-wheel 50 is then screwed onto the threaded end 49 of rod 47 to tighten the head of the rod 48 against the shell of the magazine 52. This therefore tightens magazine 4 against the handle 9, and more precisely, against the end face of the tubular section 46 of the joint 43 whilst the thumbwheel is fitted onto the tubular portion 45. In addition, the thumb-wheel can be fixed to the joint.

In the annular housing, 41 there is a small sleeve 60, made of elastomeric material which is compressible and elastic, which is also partly housed in a peripheral tubular hollow 61, along axis 42 at rest, fitted in the joint 43. The sleeve is therefore fixed solidly to the joint and may be compressed depending on the alignment of the joint.

Figure 5:
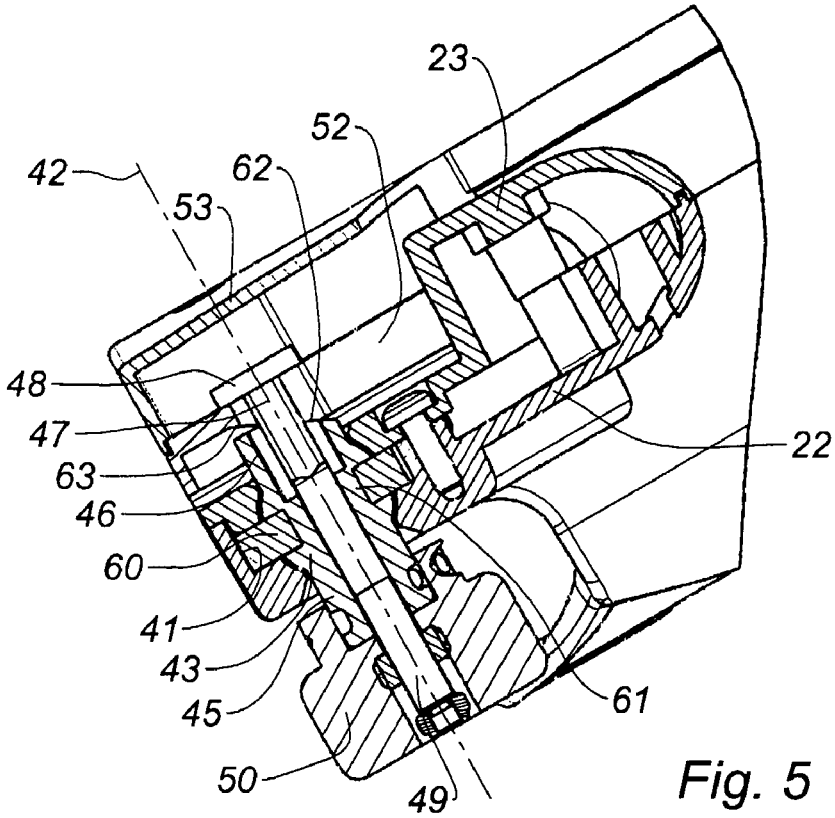
FIG. 4 is a transverse section of the handle of the apparatus and of the magazine in FIGS. 1 and 2 and FIG. 5 is a longitudinal section of the handle of the apparatus and of the magazine in the previous figures.
Figure 4:
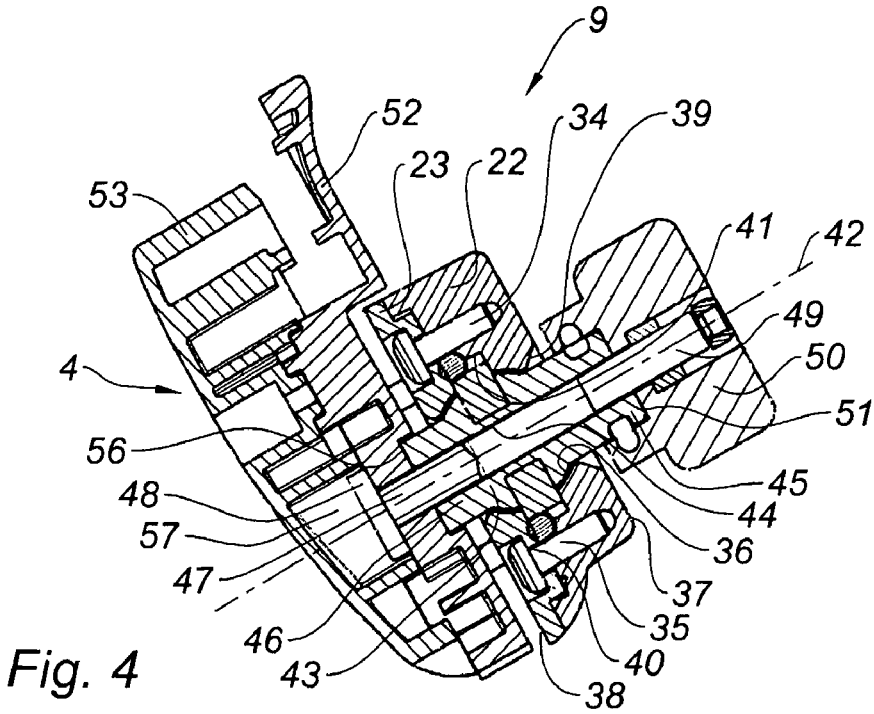

The tubular portion 46 which extends joint 43 from the magazine side is wedged to offer an inclined face 62 which is inclined in a clockwise direction on a transverse plane of the handle perpendicular to the support structure 25, effectively parallel to axis 2 of the apparatus and containing axis 42 (the plane in FIG. 4) the inclination of which is determined in a longitudinal plane of the handle (the plane in FIG. 5). The magazine shell 52 is shaped in a corresponding manner to present in opening 57 a face 63 which is inclined in the same manner and which cooperates with the inclined face 62 of the joint and so acts as a wedge. The two inclined faces 62, 63 are crossed by the fixing rod 47.

If because of the advance of the nose 3 of the apparatus during firing or because of the dimensions of the various components of the equipment, the feed end 55 of magazine 4 is not held fully against the barrel 1 and the nose 3 of the apparatus, tightening thumb-wheel 50 onto the threaded rod 47 will cause the two inclined faces to slide against each other, that is, magazine 4 on handle 9, to move the magazine towards the nose and correct the placement of the magazine against he nose of the apparatus. The relative position of the free ends of handle 33 and of the loading end 54 of the magazine are thus altered. This sliding movement is possible because rod 47 which is embedded in joint 43 may pivot or rock around a point on its axis thanks to joint 43 which can rotate in its housing 36 and compress the elastomeric tubular insert 60. Rod 47 is thus articulated inside the joint 43 in the handle 9. It will be noted that the rotation of joint 43 is also possible due to the conical openings 39, 40 which allow tubular sections 45, 46 to pivot during rotation of the joint.

The advantage to be obtained from fitting the joint in a compressible and elastic sleeve is that it softens the wedge effect and provides a means of returning the joint to its at-rest position for assembly and disassembly of the apparatus.

Finally, the use of a larger capacity (and therefore longer) loader could be foreseen. In this case the rear fixing point of the loader could no longer be at its loading end, but at a point located in the middle section.

The invention claimed is:

1. A fastening element driving apparatus, comprising:
a barrel;
means for driving a fastening element in the barrel; and
a handle containing means for receiving a removable magazine for feeding fastening elements to the barrel;
wherein
a forward part of the apparatus is arranged to cooperate with a supply end of the magazine and ensure that a fastening element is transferred from the magazine into the barrel;
a free end of the handle away from the barrel carries a rod for fixing another, loading end of the magazine thereto;
the fixing rod is fitted in a ball and socket joint in the handle to be pivotable to alter a relative position between the free end of the handle and the loading end of the magazine; and
the ball and socket joint is mounted in an elastic return sleeve.

2. The apparatus as claimed in claim 1, wherein the fixing rod is pivotable against action of the elastic return sleeve.

3. The apparatus as claimed in claim 2, wherein the fixing rod is cylindrical and is pivotable around a point on an axis thereof.

4. The apparatus as claimed in claim 1, wherein the fixing rod includes a threaded end which carries a thumb-wheel for tightening the magazine to the handle.

5. The apparatus as claimed in claim 4, wherein the fixing rod further comprises, at an end opposite to the threaded end, a head arranged for abutting against the magazine and tightening the magazine against the handle.

6. The apparatus as claimed in claim 1, wherein the free end of the handle comprises an inclined face arranged to cooperate with another inclined face on the magazine to act as a wedge for moving the magazine towards the forward part of the apparatus and for pushing the supply end of the magazine against the barrel.

7. A fastening element driving apparatus, comprising:
a barrel;
means for driving a fastening element in the barrel; and
a handle containing means for receiving a removable magazine for feeding fastening elements to the barrel;
wherein
a forward part of the apparatus is arranged to cooperate with a supply end of the magazine and ensure that a fastening element is transferred from the magazine into the barrel;
a free end of the handle away from the barrel carries a rod for fixing another, loading end of the magazine thereto;
the fixing rod is fitted in a ball and socket joint in the handle to be pivotable to alter a relative position between the free end of the handle and the loading end of the magazine; and
the ball and socket joint comprises two tubular extensions that emerge from the handle through conical openings.

8. The apparatus as claimed in claim 7, wherein the fixing rod extends into a bore created in the joint and the tubular extensions.

9. The apparatus as claimed in claim 7, wherein one of the tubular extensions extends towards the magazine and contains an inclined face arranged to cooperate with another inclined face on the magazine, to act as a wedge for moving the magazine towards the forward part of the apparatus and for pushing the supply end of the magazine against the barrel.

10. The apparatus as claimed in claim 9, wherein the fixing rod has a threaded end fitted with a thumb-wheel for tightening the magazine to the handle and pushing the magazine towards the forward part of the apparatus.

11. The apparatus as claimed in claim 10, wherein the thumb-wheel is fitted over one of the tubular extensions of the joint.

12. A removable magazine for feeding fastening elements to a barrel of a fastening element driving apparatus, said magazine comprising:

a supply end which is adapted to cooperate with a forward part of the apparatus to transfer a fastening element from the magazine into the barrel of the apparatus;

a loading end which is opposite to the supply end in a longitudinal direction of the magazine, and comprises a hole through which a fixing rod is insertable to detachably fasten the loading end of the magazine to a handle of the apparatus; and an inclined face which is oblique to both the longitudinal direction of the magazine and an axis of the hole, and is adapted to cooperate with and slide on another inclined face of the handle of the apparatus, when the inclined faces are compressed against each other by the fixing rod that fastens the loading end of the magazine to the handle of the apparatus, to act as a wedge that moves the magazine in the longitudinal direction thereof towards the forward part of the apparatus for pushing the supply end of the magazine against the barrel of the apparatus;

wherein the hole extends through the inclined surface of the magazine.

13. A fastening element driving apparatus, comprising:

a barrel for receiving, from a supply end of a magazine, a fastening element to be driven;

a handle comprising a first portion attached to the barrel and an opposite, second portion which is away from the barrel and to which an opposite, loading end of the magazine is to be fastened;

a fixing rod for fastening the loading end of the magazine to the second portion of the handle; and a joint pivotably fitted inside the second portion of the handle and rotatable about a plurality of axes;

wherein said joint having a bore through which said fixing rod is insertable to be supported by said joint and to be rotatable relative to the second portion of the handle about said plurality of axes, thereby allowing a relative position between the supply end of the magazine and the barrel to be adjusted by altering a relative position between the loading end of the magazine and the second portion of the handle;

wherein the plurality of axes extend through a point of an axis of the fixing rod.

14. A fastening element driving apparatus, comprising:

a barrel for receiving, from a supply end of a magazine, a fastening element to be driven;

a handle comprising a first portion attached to the barrel and an opposite, second portion which is away from the barrel and to which an opposite, loading end of the magazine is to be fastened;

a fixing rod for fastening the loading end of the magazine to the second portion of the handle; and a joint pivotably fitted inside the second portion of the handle and rotatable about a plurality of axes;

wherein said joint having a bore through which said fixing rod is insertable to be supported by said joint and to be rotatable relative to the second portion of the handle about said plurality of axes, thereby allowing a relative position between the supply end of the magazine and the barrel to be adjusted by altering a relative position between the loading end of the magazine and the second portion of the handle;

said apparatus further comprising an elastic sleeve which is in the second portion of the handle and in which the joint is mounted.

15. A fastening element driving apparatus, comprising:

a barrel for receiving, from a supply end of a magazine, a fastening element to be driven;

a handle comprising a first portion attached to the barrel and an opposite, second portion which is away from the barrel and to which an opposite, loading end of the magazine is to be fastened;

a fixing rod for fastening the loading end of the magazine to the second portion of the handle; and a joint pivotably fitted inside the second portion of the handle and rotatable about a plurality of axes;

wherein said joint having a bore through which said fixing rod is insertable to be supported by said joint and to be rotatable relative to the second portion of the handle about said plurality of axes, thereby allowing a relative position between the supply end of the magazine and the barrel to be adjusted by altering a relative position between the loading end of the magazine and the second portion of the handle;

wherein the second portion of the handle comprises an inclined face which is oblique to both (i) a longitudinal direction of the handle between the first and second portions and (ii) an axis of the fixing rod, and adapted to cooperate with and slide on another inclined face of the magazine, when the inclined faces are compressed against each other by the fixing rod that fastens the loading end of the magazine to the second portion of the handle, to act as a wedge that moves the magazine in a longitudinal direction thereof towards the barrel for pushing the supply end of the magazine against the barrel of the apparatus.

16. A fastening element driving apparatus, comprising:

a barrel for receiving, from a supply end of a magazine, a fastening element to be driven;

a handle comprising a first portion attached to the barrel and an opposite, second portion which is away from the barrel and to which an opposite, loading end of the magazine is to be fastened;

a fixing rod for fastening the loading end of the magazine to the second portion of the handle; and a joint pivotably fitted inside the second portion of the handle and rotatable about a plurality of axes;

wherein said joint having a bore through which said fixing rod is insertable to be supported by said joint and to be rotatable relative to the second portion of the handle about said plurality of axes, thereby allowing a relative position between the supply end of the magazine and the barrel to be adjusted by altering a relative position between the loading end of the magazine and the second portion of the handle;

the joint comprises two tubular extensions that project from the second portion of the handle through outwardly flared openings.

17. The apparatus as claimed in claim 16, wherein one of the tubular extensions extends towards the magazine and contains an inclined face which is oblique to both (i) a longitudinal direction of the handle between the first and second portions and (ii) an axis of the fixing rod, and adapted to cooperate with and slide on another inclined face of the magazine, when the inclined faces are compressed against each other by the fixing rod that fastens the loading end of the magazine to the second portion of the handle, to act as a wedge that moves the magazine in a longitudinal direction thereof towards the barrel for pushing the supply end of the magazine against the barrel of the apparatus.

18. The apparatus as claimed in claim 16, further comprising a thumb-wheel threadedly engageable with a threaded end of the fixing rod for tightening the magazine to the handle, wherein the thumb-wheel is fitted over one of the tubular extensions of the joint.

* * * * *